US006974381B1

(12) United States Patent
Walker et al.

(10) Patent No.: US 6,974,381 B1
(45) Date of Patent: Dec. 13, 2005

(54) DROP CEILING AIR FLOW PRODUCER

(76) Inventors: Keith Lloyd Walker, 2210 Dale Ridge Drive, Oakville, Ontario (CA) L6M 3L4; Alan Richard Monro, 3050 Orleans Road, Unit 68, Mississauga, Ontario (CA) L5L 5P7; Christopher Henry Kozlowski, 1491 Hollywell Avenue, Mississauga, Ontario (CA) L5N 4P2

( * ) Notice: Subject to any disclaimer, the term of this patent is extended or adjusted under 35 U.S.C. 154(b) by 0 days.

(21) Appl. No.: 10/925,906

(22) Filed: Aug. 26, 2004

(51) Int. Cl.[7] ..... F24F 7/007
(52) U.S. Cl. ..... 454/230
(58) Field of Search ..... 454/230, 233, 454/234

(56) References Cited

U.S. PATENT DOCUMENTS

| | | | | |
|---|---|---|---|---|
| 2,221,703 | A | 11/1940 | Falco | |
| 2,700,331 | A * | 1/1955 | Miller | 454/230 |
| 2,875,316 | A | 12/1959 | Ford et al. | |
| 3,223,828 | A | 12/1965 | Mast | |
| 3,320,406 | A | 5/1967 | Wainwright | |
| 3,347,025 | A | 10/1967 | Wiley | |
| 4,560,395 | A | 12/1985 | Davis | |
| 4,662,912 | A * | 5/1987 | Perkins | 96/140 |
| 4,730,551 | A | 3/1988 | Peludat | |
| 5,001,968 | A | 3/1991 | Sodec et al. | |
| 5,078,574 | A | 1/1992 | Olsen | |
| 5,624,311 | A * | 4/1997 | Peludat | 454/230 |
| 6,168,517 | B1 | 1/2001 | Cook | |
| 6,551,185 | B1 | 4/2003 | Miyake et al. | |

* cited by examiner

*Primary Examiner*—Harold Joyce

(57) ABSTRACT

An air flow producer of non-rectangular shape is adapted for installation in a rectangular opening of a drop ceiling. In preferred form, the producer has a circular housing with an open bottom covered with a grill. A fan with a rotary blade assembly is mounted in the housing to produce a downward air flow, and a circular metal band surrounding the rotary blade assembly defines an air discharge zone centered in the grill and an annular air intake zone surrounding the discharge zone. Flow rates are optimized by positioning the band close to the grill. The grill is preferably integrally molded with a rectangular flange that seats in the drop ceiling opening. The flange supports the housing from the framework and closes the opening to prevent the producer from drawing air from the plenum above the drop ceiling.

14 Claims, 5 Drawing Sheets

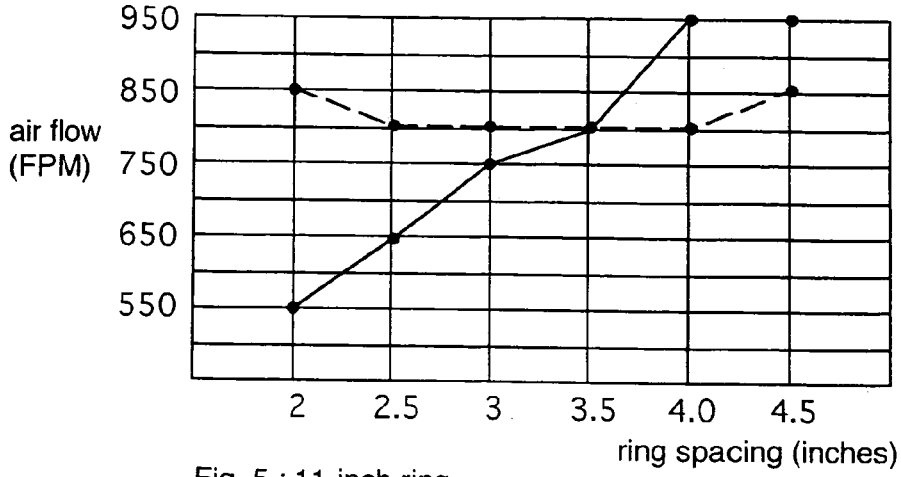
Fig. 5 : 11-inch ring
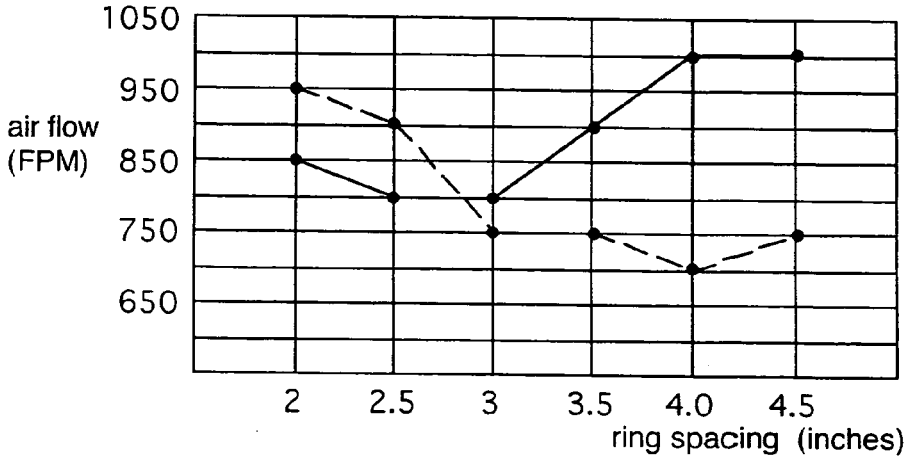
Fig. 6 : 13–inch ring
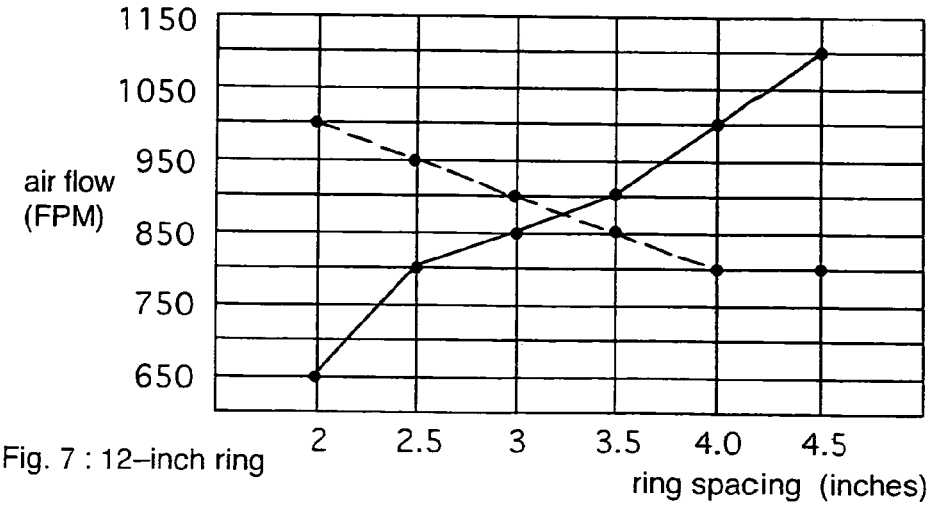
Fig. 7 : 12–inch ring

DROP CEILING AIR FLOW PRODUCER

FIELD OF THE INVENTION

The invention relates generally to air flow producers for reducing temperature gradients in a room, and, more specifically, to air flow producers adapted for installation in drop ceilings.

BACKGROUND OF THE INVENTION

It is well known that warm air forced into a room or derived from radiators tends to rise toward the ceiling of a room while cooler air tends to accumulate near the floor. This produces a temperature gradient that exposes individuals to colder room air during winter months and increases heat loss through ceilings and roofs. A corresponding problem arises during summer months. Individuals may experience a room as being hot because cool air discharged from air conditioning units tends to settle to the floor. Thermostat setting are often changed to obtain more heat or more cool air. In either case, the net result is increased energy consumption and higher cooling and heating costs.

It is also well known that ceiling fans can reduce room temperature gradients and consequently heating costs. The air flows from a ceiling fan tend, however, to spread rapidly, reducing the ability to affect temperature differentials. It is now common practice to use an air flow producer that produces a vertical column of air if significant temperature gradients and attendant heating and air conditioning costs are to be reduced.

A particular producer configuration is used for drop ceilings. Such ceilings have a framework, usually an assembly of T-bars and hangers that suspend the T-bars from a supradjacent ceiling. The framework defines rectangular openings with standard dimensions in which ceiling panels are seated. Building codes often specify that air flow producers used in drop ceilings are not to draw air from the plenum above. In such applications, an air flow producer must both receive and discharge air from below the drop ceiling. Such devices are identified in this specification as "drop ceiling air flow producers" or with comparable terms.

Prior art drop ceiling producers have commonly used a rectangular housing that conforms to dimensions of a seating opening and the rectangular seating structure surrounding the opening. Apart from seating the producer, this arrangement closes the opening against immediate intake of plenum air. Intake and discharge zones are defined in a flow grill overlaying the open bottom of the housing. A fan with a rotary blade assembly is mounted centrally within the housing, and a circular band surrounds the blade assembly to separate intake and discharge air flows. The band forces air flows from the fan through a circular discharge zone centered in the flow grill. Peripheral sections of the grill serve as an intake zone to supply air to the fan. To avoid custom fabrication, the flow producer will usually be manufactured with a standard square housing whose sides conform to standard spacing between drop ceiling rails, usually 24 inches. During installation, the rails of the drop ceiling are adjusted to define a square opening and seating structure that accommodate the square producer.

Such air flow producers have been promoted as being very efficient for production of high-volume, columnar air flows. However, the inventors have discovered that an alternative configuration tends to be more efficient and can be adapted to fit into standard rectangular openings in a drop ceiling framework.

SUMMARY OF THE INVENTION

In general terms, this specification offers solutions to two principal problems. First, it provides a circular drop ceiling air flow producer that can exceed the performance of certain commercially available prior art square units. Second, it provides a convenient approach to installing a non-rectangular drop ceiling air flow producer (such as a circular producer) in a rectangular opening in a drop ceiling without drawing air from the plenum above.

In one aspect, the invention provides a drop ceiling air flow producer adapted to mount in a rectangular seating opening of a drop ceiling framework. The air flow producer comprises a housing with a circular-cylindrical side wall, a closed top and an open bottom. A flow grill overlays the open bottom of the housing, and a fan is supported from within the housing. The fan has a rotary blade assembly centered about a central vertical axis of the housing and operable to discharge air through the grill. A circular flow-separating ring or band is centered about the vertical axis and surrounds the blade assembly. The band defines a generally circular air discharge zone centered in the grill, and an annular air intake zone radially or horizontally outward of the discharge zone. The producer includes a flange with a generally rectangular periphery. The flange extends horizontally outward relative to the side wall of the housing, and conforms in shape to the opening and seating structure. This prevents immediate intake of air from the plenum above the drop ceiling.

The circular configuration of the producer lends itself to higher air flow rates. It has also been discovered that the circular flow-separating band should be positioned differently than in prior art rectangular producers to maximize performance. In particular, performance of the prior art rectangular producers improves as the band is positioned in the upper half of the housing. In the circular housing configuration of the invention, flows rates improve markedly when the band is located in the lower half of the housing, preferably within 1 or 2 inches inches from the open bottom and the top of the flow grill.

Other aspects of the invention will be apparent from a description below of a preferred embodiment and will be more specifically defined in the appended claims. A number of matters of interpretation should, however, be noted. The term "circular-cylindrical" and comparable terms should be understood as comprising a cylindrical periphery with a circular cross-section. The term "rectangular" should be understood as encompassing "square." Use of length measurements with decimal places should not be interpreted as requiring exacting precision. For example, "23.75 inches" as used to identify the diameter of a housing should be viewed essentially as shorthand for "23 and three-quarter inches" and not as a direction to machine components to two decimal places. Also, no distinction should be drawn between measurements such as "5.0 inches" and "5 inches" as no such distinction is intended. The invention does not require exacting measurement of components.

DESCRIPTION OF THE DRAWINGS

The invention will be better understood with reference to drawings in which:

FIGS. 5–7 are graphs comparing air flows produced by the circular air flow producer and a conventional square air flow producer as a function of the size and position of a flow dividing band in each unit.

DESCRIPTION OF PREFERRED EMBODIMENT

Figure 1:
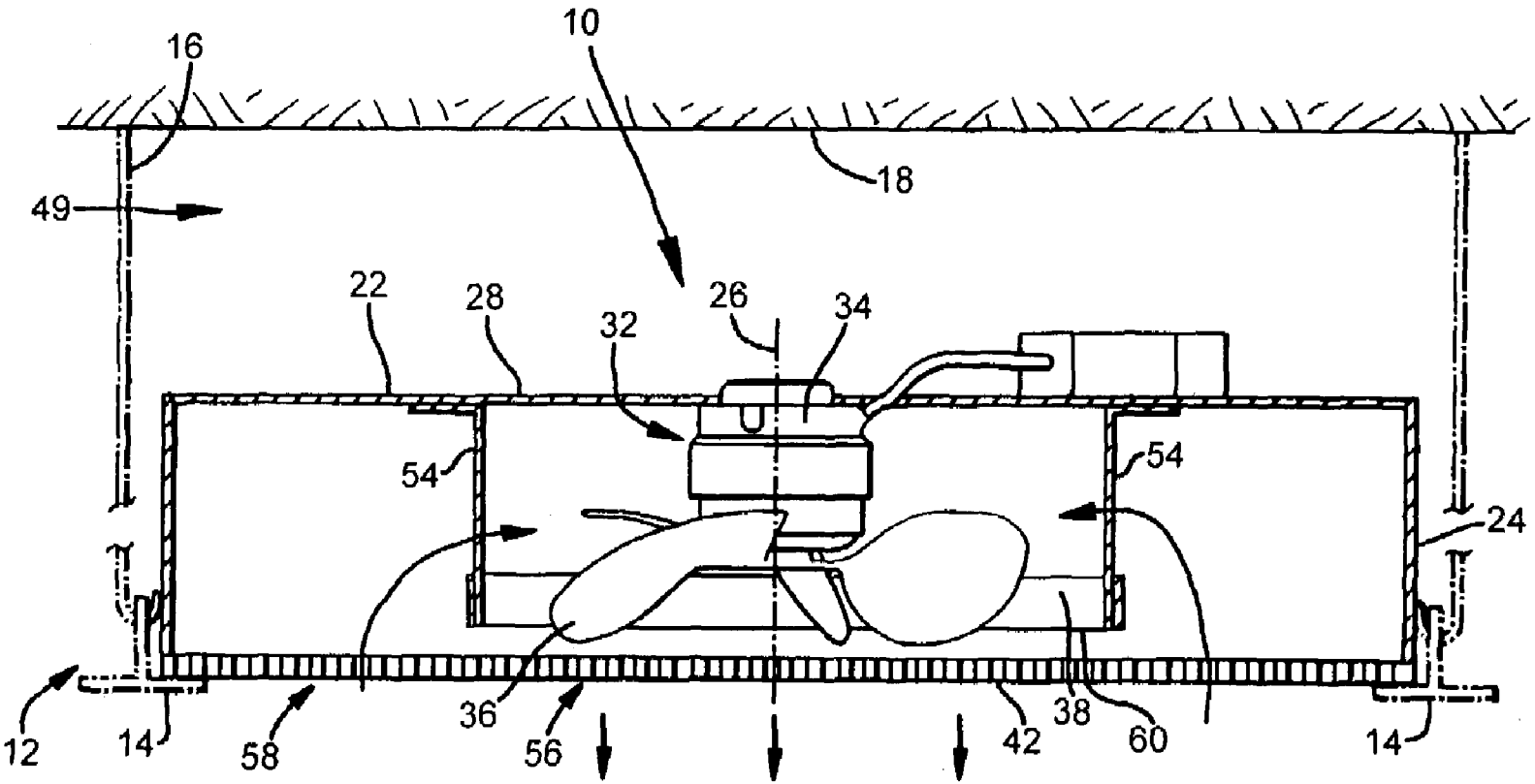
FIG. 1 is a partial cross-section in a vertical plane of a circular air flow producer mounted on a drop ceiling with intake and discharge air flows indicated with arrows.
Figure 2:
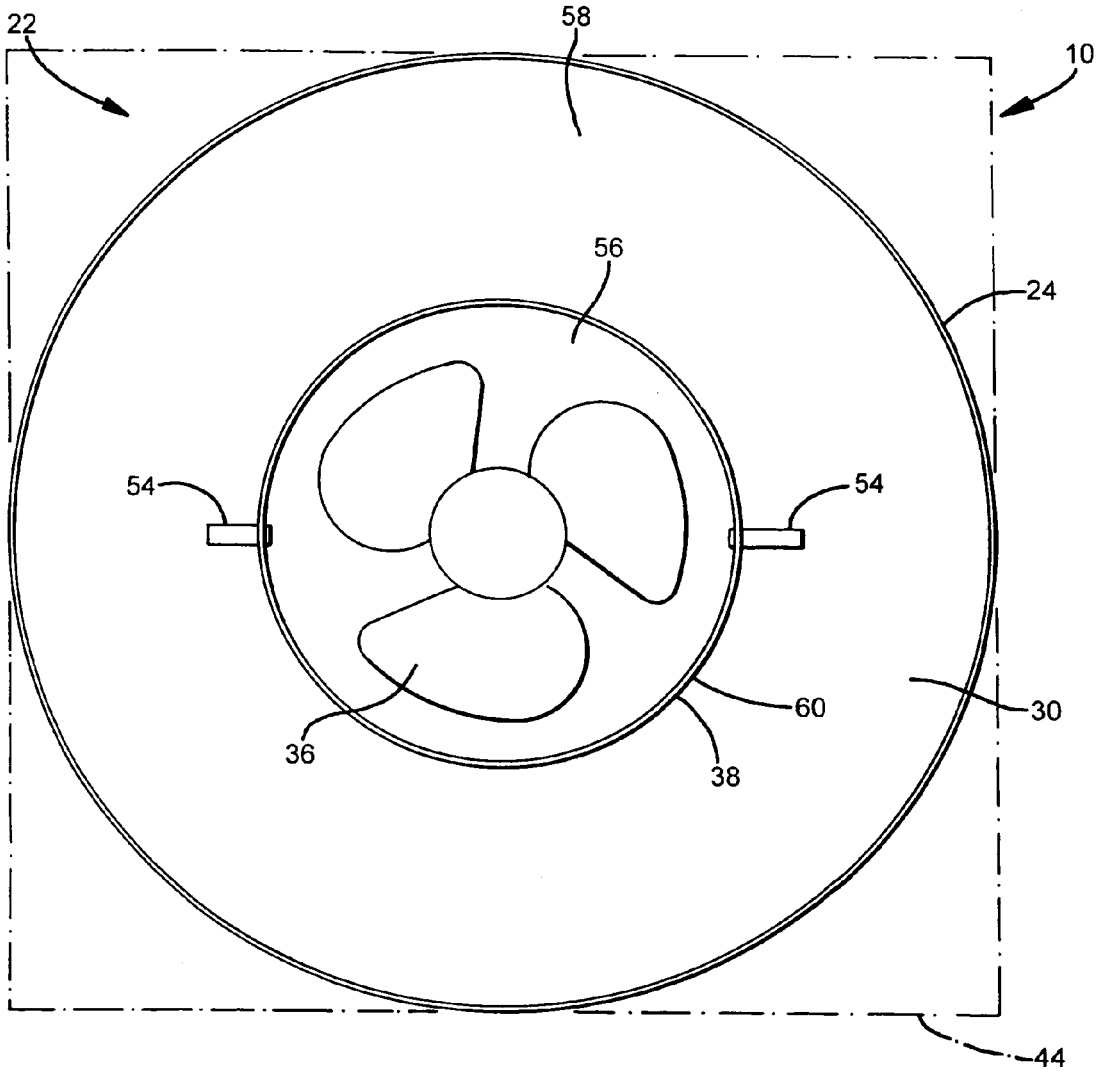
FIG. 2 a plan view of the air flow producer from below with a air flow grill removed.
Figure 3:
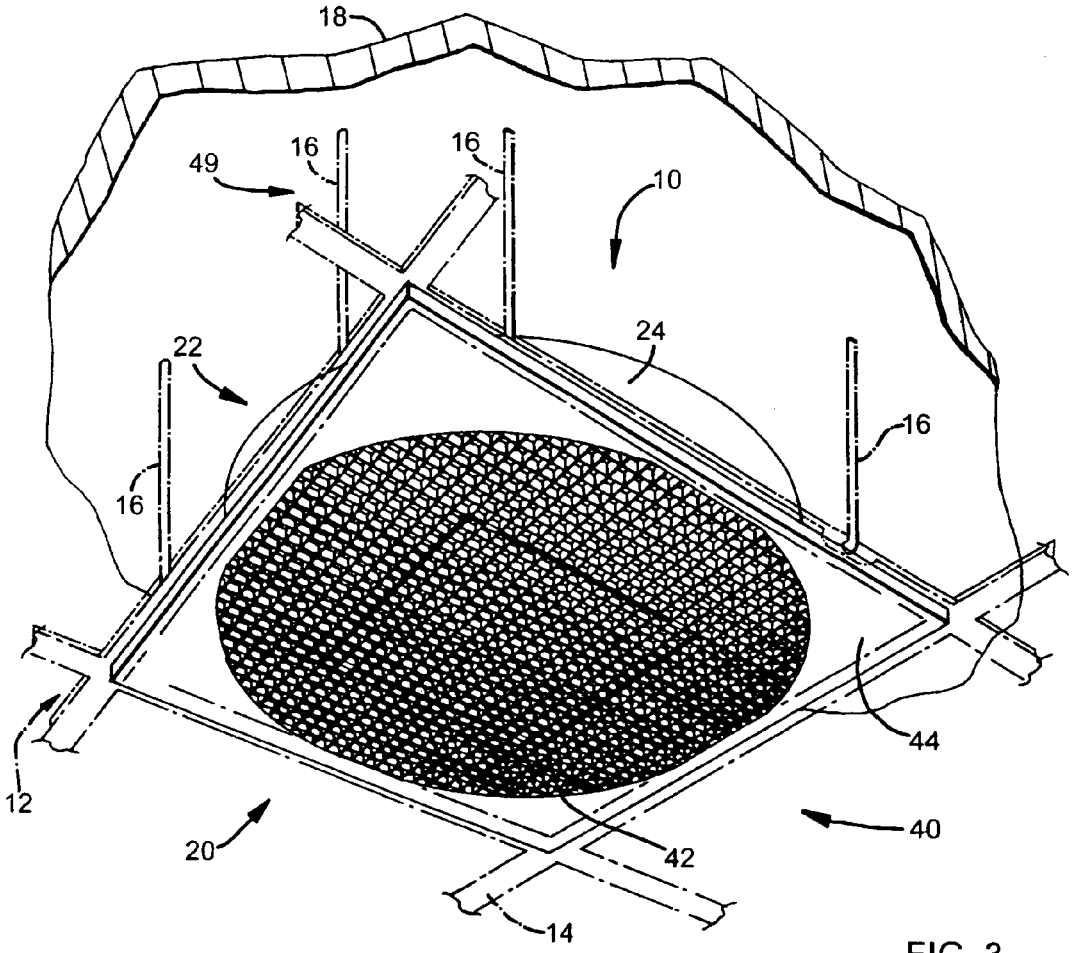
FIG. 3 is a fragmented perspective view further detailing the mounting of the air flow producer to ceiling structures.

Reference is made to FIGS. 1–3 which illustrate an air flow producer 10 adapted to produce a high-volume columnar air flow. The producer 10 is specifically adapted for installation in a drop ceiling 12. As most apparent in FIGS. 1 and 3, the drop ceiling 12 comprises a framework of horizontal T-bars 14 and vertical hooks 16 (most apparent in FIG. 3) that support the T-bars 14 from the supradjacent ceiling 18. In this instance, the T-bar framework is adjusted in a conventional manner to define a square opening, generally indicated with reference numeral 20 in FIG. 3, and square seating structure surrounding the opening 20. The producer 10 seats in the opening 20, and draws air from and discharges air below the drop ceiling 12.

The air flow producer 10 has a generally circular housing 22 constructed of sheet metal. The housing 22 has a circular-cylindrical side wall 24 centered about a vertical axis 26 (shown in FIG. 1), a closed top 28 and an open bottom 30. The side wall 24 has a diameter of about 23.75 inches and a height of about 5 inches. The housing 22 contains a fan 32 with an electric motor 34 and a rotary blade assembly 36 (most apparent in FIGS. 1 and 2). The motor 34 is suspended centrally from the top 28 of the housing 22, and the blade assembly 36 rotates about the vertical axis 26, producing a downward air flow. A circular band 38 separates air flows to and from the blade assembly 36.

The producer 10 includes an integrally molded assembly 40 comprising a circular flow grill 42 and a flange 44 that surrounds the circular grill 42 and has a square periphery. The flow grill 42 focus air flows parallel to a flow axis (parallel to the vertical axis 26 of the housing 22) and prevents accidental contact with the fan 32. Such grills are well known and often formed with a latticework of plastic partitions, louvers or other apertured structures designed to reduce scattering of air flows and discharge air flows in a particular direction. Grills, screens or apertured members with such properties are referred to in this specification collectively as "flow grills" or "air flow grills."

Figure 4:
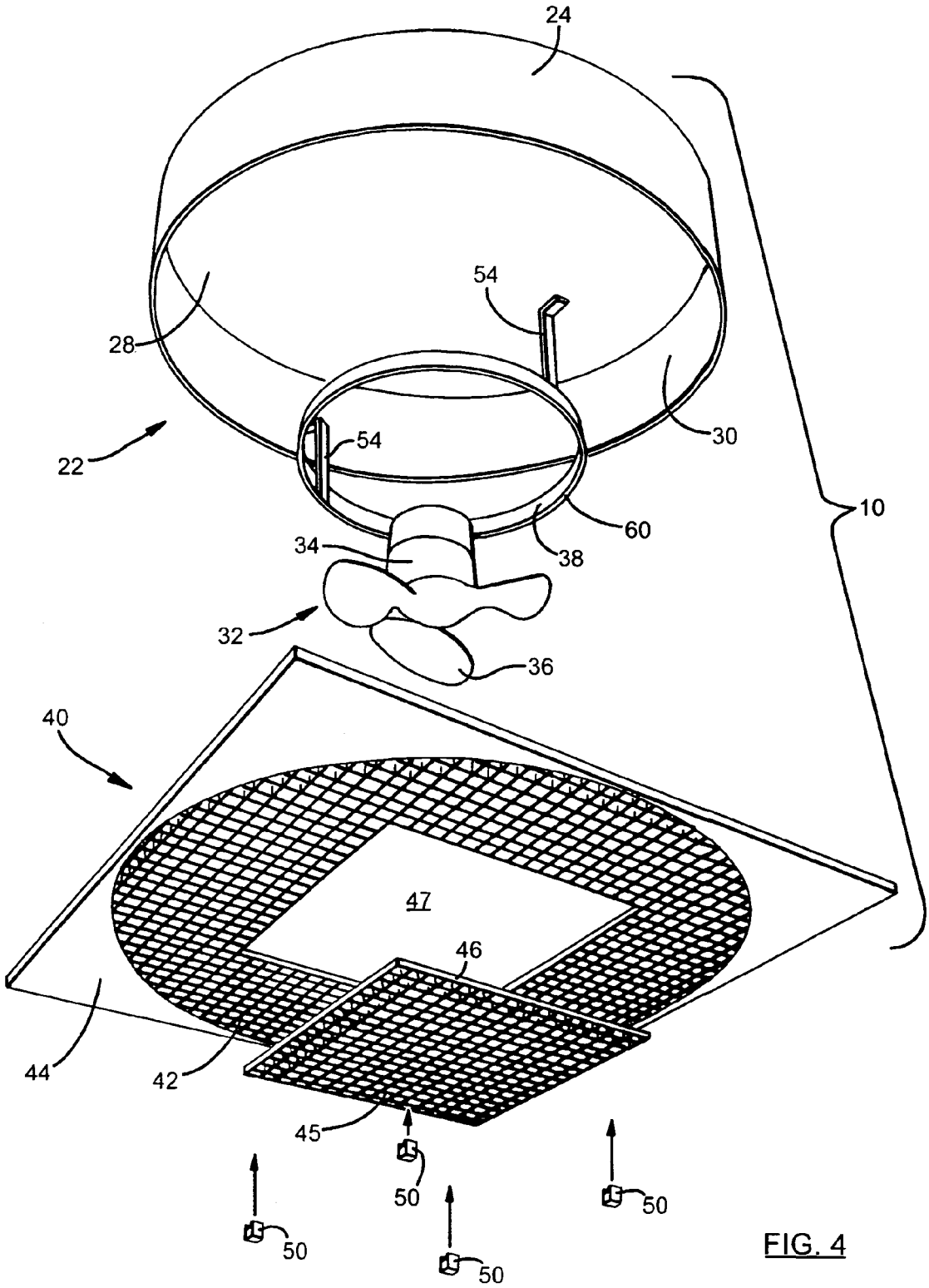
FIG. 4 is an exploded perspective view of the air flow producer.

A central square section 45 of the grill 42 serves as a removable access panel or door (identified with the same reference number 45.) Although part of the grill 42, the square access door 45 is molded as a separate component and has a solid outer side wall 46 (shown only in FIG. 4). The outer, generally circular section of the grill 42 has a square access opening 47 surrounded by an inner square wall 48 molded with the assembly 40 and dimensioned to closely receive the outer side wall 46 of the access door 45. In FIG. 3, the access door 45 is shown in an operating orientation in the general plane of the grill 42, closing the access opening 47. In FIG. 4, the access door 45 is shown removed from the rest of the grill 42, allowing access through the opening 47 to the fan 32 for cleaning and repair.

Hinges and latches may be used to releasably mount the access door 45 to the rest of the grill 42 for easy opening and closing. However, the access door 45 is preferrably fastened with U-shaped clips 50 that releasably mount about the outer side wall 46 of the door 45 and the adjacent inner wall 48 in the grill 42. This avoids large structures that potentially disrupt air flows. To reduce potential disruption of discharge flows, the access door 45 is dimensioned so that its peripheral side wall 46 lies horizontally outside of the discharge zone 56, as does the inner side wall 48 that defines the conforming access opening 47. For example, if the blade assembly has a diameter of 10 inches and the circular band has a diameter of 12 inches, then the access door 45 may be 14 inches square and centered like other components about the housing axis 26.

The flange 44 conforms in shape and dimensions to the opening 20 in the drop ceiling 12, more specifically to the T-bar seating structure surrounding the opening 20, as apparent from FIGS. 1 and 3. This closes the opening 20 against any significant intake of air from the supradjacent plenum 49. The flange 44 is essentially shaped like a square in which a circle (the circular housing 22) is inscribed. The flange 44 protrudes markedly at corners of the opening 20 but retreats toward the side wall 24 of the housing 22 midway between the corners. It is not critical that the flange 44 be continuous at midpoints between corners since T-bars will normally obstruct such locations against drawing of air from an overhead plenum.

In this embodiment, the housing 22 rests on the assembly 40 and is separable. For additional safety, the housing 22 may be independently supported from the supradjacent ceiling 18, as required by building codes in certain jurisdictions.

Although the inventors prefer that the flange be integrally molded with the air flow grill, another approach is to begin with a rectangular grill adapted to fit into a rectangular drop ceiling opening of predetermined dimensions. Flow openings around the periphery of the grill are then closed until a substantially circular grill opening remains, appropriate for the particular circular air flow producer to be used. The covered areas form the desired rectangular flange and function to prevent any significant amount of air from being drawn from a plenum above. In initial tests of the inventive concept, the inventors overlaid peripheral sections of a square flow grill with duct tape to close flow openings and ultimately to arrive at a combined circular grill and an air-impermeable square flange. Other approaches may be taken.

The flow-separating band 38 is a one-inch metal strap suspended with metal struts 54 from the top 28 of the housing 22. The band 38 is centered about the rotational axis of the blade assembly 36, and has a diameter typically one to two inches greater than the diameter of the blade assembly 36. As indicated in FIG. 1, the band 38 defines a central discharge zone (outlet) 56 in the grill 42, and an annular intake zone (inlet) 58 surrounding the discharge zone 56. Intake air flows have been indicated with a pair of curved arrows on opposite sides of the fan 32; discharge air flows have been indicated with three vertical arrows below the grill 42. Ideally no air is drawn from the plenum 49 above the drop ceiling 12.

FIGS. 5–7 are graphs comparing air flows generated by a prototype of the producer 10 and a prior art square producer. For ease of reference, the prototype will be referred to as the "producer 10." Each producer had a housing with a height of 5 inches. The width of housing of the square producer was equal to the diameter of the circular housing 22 of the producer 10. The producers were equipped with identical fans and identical flow-separating bands. During testing, smoke flow rates through the producers were measured in feet per minute (FPM). Since the bands constrain discharge flows to circular zones of common diameter, the measurements in FPM are directly related to volumetric flows through the two producers. The bands were spaced at different distances from the top of each producer's housing to arrive at an optimal flow rate for each unit. Such tests were conducted for three different band diameters (11, 12 and 13 inches) as specifically identified in FIGS. 5–7. In each graph, the vertical axis represents producer air flow in FPM. The horizontal axis represents the distance of the producer's flow-separating circular band from the top of its housing, such distance being measured from the top of the housing to the bottom edges of the 1-inch tall bands). For certainty of understanding, the lower edge of the circular band 38 is indicated with reference numeral 60 in FIG. 4. Dashed lines identify flow rates associated with the prior art square producer; solid lines, flow rates for the producer 10. The points indicated in the graphs have been rounded to the nearest 50 FPM.

An unusual effect was noted. With a square producer, air flow rates tended to drop as the unit's flow-dividing band was positioned closer to the bottom of its housing. In contradistinction, using the circular housing 22 of the producer 10, air flow rates tended to rise as the band 38 was placed closer to the open housing bottom 30. The effect was most pronounced when using a 12-inch flow dividing band in each unit, as apparent in the graph of FIG. 7. In the square producer, flow rates declined steadily from 1000 FPM to 800 FPM as its flow-dividing band was moved from 2 inches to 4 inches from the housing top. In the producer 10, the flow rate rose steadily from 650 FPM to 1100 FPM as the band was moved from 2 inches below the housing top to 4.5 inches. It will be apparent from the graphs of FIGS. 5–7 that flow rates are superior in the producer 10 when the circular flow-dividing band 38 is positioned within 4.0 to 4.5 inches from the top 28 of the housing 22. Alternatively viewed, flow rates in the producer 10 are optimized when the band 38 is spaced 0.5 to 1 inches from the top of the grill 42 or open bottom 30 of the housing 22 (as measured to the bottom edge 60 of the band 38).

It will be appreciated that a particular embodiment of the invention has been described and illustrated, and that modifications may be made therein without departing from the spirit of the invention or the scope of the appended claims.

We claim:

1. An air flow producer adapted for installation on a seating structure surrounding a rectangular opening in a drop ceiling, the air flow producer comprising:

a housing with a vertical axis, a circular-cylindrical side wall centered about the axis, a closed top and an open bottom;

a fan located in and supported from the housing, the fan comprising a rotary blade assembly rotating about the vertical axis and producing an air flow through the open bottom of the housing;

an air flow grill overlaying the open bottom of the housing;

a circular flow-separating cylindrical band supported from the housing proximate to the open bottom, the band centered about the vertical axis and extending around the blade assembly, the band defining an air discharge zone centered in the grill and an annular air intake zone radially outward of the discharge zone; and, means defining a flange with a generally rectangular periphery for supporting the housing from the seating structure, the flange extending horizontally outward relative to the side wall of the housing and conforming to the seating structure thereby to close the opening against flow of air.

2. The air flow producer of claim 1 in which the air flow grill comprises:

a central access opening for accessing the fan;

a central grill section moveable relative to the rest of the grill; and, mounting means for releasably mounting the grill section in the access opening.

3. The air flow producer of claim 2 in which:

the central grill section is displaceable vertically relative to the rest of the grill; and, the mounting means comprise a plurality of clips securing adjacent portions of the grill section and the rest of the grill to one another.

4. The air flow producer of claim 2 in which the access opening has a periphery that extends beyond the flow-separating band in all horizontal directions.

5. The air flow producer of claim 1 in which the flow-separating band has a lower horizontal edge located in a lower quarter of the housing.

6. The air flow producer of claim 5 in which the lower edge of the flow-separating band is positioned within 1 inch of the open bottom of the housing.

7. The air flow producer of claim 1 in which:

the side wall of the housing has an outer diameter of about 23.75 inches and a height of about 5 inches;

the blade assembly has a diameter of about 10 inches;

the flow-separating band has a diameter between about 11 inches and 13 inches; and, the flow-separating band has a lower horizontal edge spaced between about 4.0 and about 4.5 inches from the top of the housing.

8. The air flow producer of claim 1 in which:

the side wall of the housing has a diameter of about 23.75 inches and a height of about 5 inches;

the blade assembly has a diameter of about 10 inches;

the flow-separating band has a diameter of about 12 inches; and, the flow-separating band has a lower horizontal edge spaced between about 0.5 inches and about 1.0 inch above the open bottom of the housing.

9. An air flow producer adapted for installation on a rectangular seating structure surrounding an opening in a drop ceiling, the air flow producer comprising:

a housing comprising a vertical axis, a non-rectangular side wall centered about the axis, a closed top and an open bottom;

an air flow grill overlaying the open bottom of the housing a fan located in and supported from the housing, the fan comprising a rotary blade assembly rotating about the vertical axis, the fan drawing air through the open bottom of the housing and discharging air through the open bottom;

a circular flow-separating cylindrical band mounted in the housing, the flow-separating band is centered about the vertical axis and extends around the blade assembly, the flow-separating band defining an air discharge zone centered in the grill and an air intake zone radially outward of the discharge zone; and support means for supporting the housing on the seating structure, the support means comprising solid structure defining a generally rectangular periphery extending horizontally outward relative to the side wall of the housing and conforming in shape to the seating structure thereby to close the opening against passage of air from above the drop ceiling.

10. The air flow producer of claim 9 in which the air flow grill comprises:

a central access opening for accessing the fan;

a central grill section moveable relative to the rest of the grill; and, mounting means for releasably mounting the grill section in the access opening to the rest of the grill.

11. The air flow producer of claim 10 in which:

the central grill section is displaceable vertically relative to the rest of the grill; and, the mounting means comprise a plurality of clips releasably securing adjacent portions of the grill section and the rest of the grill to one another.

12. The air flow producer of claim 9 in which the air flow grill comprises:

a central access opening for accessing the fan;

a central grill section moveable relative to the rest of the grill; and, mounting means for releasably mounting the grill section in the access opening to the rest of the grill.

13. The air flow producer of claim 12 in which the access opening has a periphery that extends beyond the flow-separating band in all horizontal directions.

14. The air flow producer of claim 9 in which the housing is circular-cylindrical.

* * * * *